United States Patent [19]

Klann

[11] 3,967,522

[45] July 6, 1976

[54] VALVE FOR PIPE ORGANS

[76] Inventor: Paul A. Klann, P.O. Box 2398, Waynesboro, Va. 22980

[22] Filed: Apr. 28, 1975

[21] Appl. No.: 572,579

[52] U.S. Cl. ..... 84/334; 84/339; 251/129; 251/120

[51] Int. Cl.[2] ..... G10B 3/06

[58] Field of Search ..... 251/120, 210, 118, 129; 84/334, 336, 337, 338, 339, 348, 356

[56] References Cited

UNITED STATES PATENTS

| | | | |
|---|---|---|---|
| 586,996 | 7/1897 | Glauber | 251/120 |
| 788,777 | 5/1905 | Klann | 84/334 |
| 1,767,725 | 6/1930 | Waters et al. | 251/129 X |
| 1,839,483 | 1/1932 | Humphrey | 251/129 X |

FOREIGN PATENTS OR APPLICATIONS

| | | | |
|---|---|---|---|
| 1,209,819 | 9/1959 | France | 251/129 |

*Primary Examiner*—Arnold Rosenthal
*Attorney, Agent, or Firm*—Sughrue, Rothwell, Mion, Zinn & Macpeak

[57] ABSTRACT

The valve member of a solenoid operated valve adapted to be mounted within the windchest of a pipe organ for opening and closing an aperture leading to a pipe is provided with a circular projection on one surface thereof adapted to project into the circular aperture with minimal clearance to reduce the amount of air flow through the aperture should the main portion of the valve member separate slightly from the seat surrounding the aperture as a result of bounce during a valve closing operation.

1 Claim, 3 Drawing Figures

FIG. 1
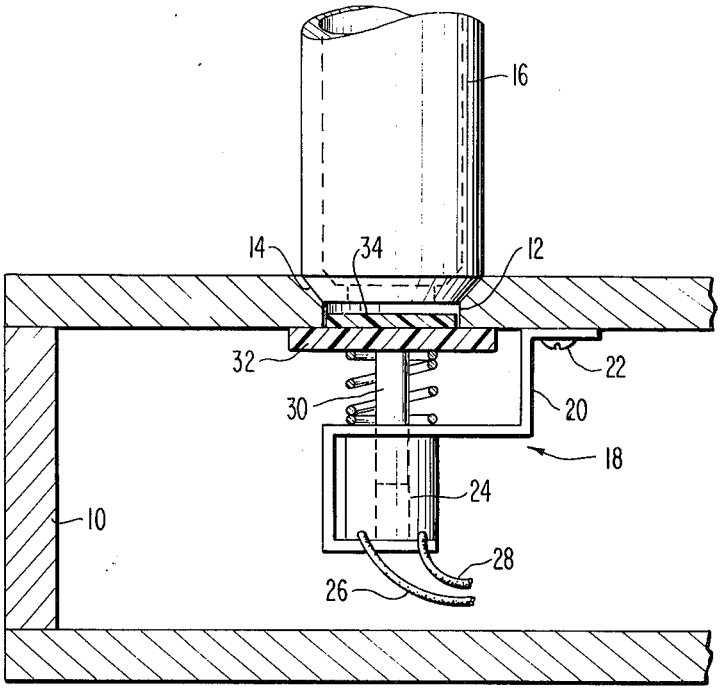
FIG. 2
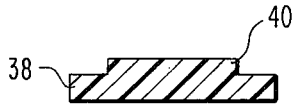
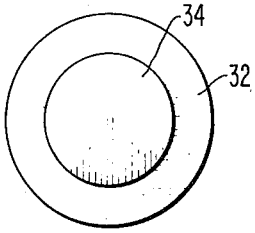
FIG. 3

VALVE FOR PIPE ORGANS

BACKGROUND OF THE INVENTION

1. Field of the Invention

The present invention is directed to a valve for a pipe organ and more specifically to the construction of the valve member per se adapted to close the windchest aperture leading to the pipe.

2. Prior Art

For many years the typical solenoid operated chest valve for a pipe organ was provided with a valve member of soft resilient material in order to minimize the noise upon closing of the valve. The valve was usually attached to a valve stem which entered the solenoid and a closing spring generally surrounded the valve stem for normally biasing the valve member into closing engagement with the windchest about the circumference of an aperture leading to a pipe. The spring generally had to be of sufficient strength so as to cause a fast return of the valve but not strong as to resist the attraction of the solenoid when it was necessary to open the valve to allow the pipe to speak.

The combined mass of the valve and valve stem, the spring force, the pressure differential between the interior of the chest and the atmosphere and the resiliency of the material used in the valve all combined to plague the valve with an unacceptable tendency to bounce during a closing operation. This was even more objectionable on fast speaking pipes since a very audible sound was produced by the air escaping into the pipe as the valve member bounced.

SUMMARY OF THE INVENTION

The present invention provides a solenoid operated chest valve for a pipe organ wherein the valve member is so constructed as to minimize the objectionable flow of air into a pipe during bounce to substantially eliminate the objectionable sound previously caused by air escaping into a pipe from the air chest during the bounce of a valve member.

The present invention provides a valve member for a solenoid operated chest valve having a flat planar surface adapted to engage the interior of the windchest about the circumference of an aperture leading to a pipe and is further provided with a circular projection on said surface having minimal circumferential clearance within the aperture so as to allow the projection to move freely within the aperture but substantially fill the aperture during a typical bounce of the main valve member from its seat during a closing operation.

The foregoing and other objects, features and advantages of the invention will be apparent from the following more particular description of preferred embodiments of the invention as illustrated in the accompanying drawings.

BRIEF DESCRIPTION OF THE DRAWINGS

FIG. 1 is a side elevation view, partly in section, of a chest valve according to the present invention disposed within the air chest.

FIG. 2 is a transverse sectional view through a valve member of modified construction.

FIG. 3 is a top plan view of the valve member per se shown in FIGS. 1 and 2.

DETAILED DESCRIPTION OF THE INVENTION

The windchest 10 shown in FIG. 1 which is adapted to hold a supply of pressurized air provided by any suitable means (not shown) is provided with a plurality of circular apertures 12 in the top thereof. The outer rim 14 of the aperture is beveled or otherwise suitably contoured for the reception of the lower end of a pipe in close fitting engagement therewith.

In order to control the flow of pressurized air from the interior of the chest 10 into the pipe 16 a solenoid operated chest valve 18 is mounted within the chest adjacent each aperture. The chest valve is comprised of a mounting bracket 20 secured to the underside of the chest top by any suitable means such as screws 22 or the like. A solenoid 24 is mounted on the bracket and is connected to any suitable source of power (not shown) by leads 26 and 28. The solenoid is provided with an armature 30 of magnetically responsive material which reciprocates within the hollow core of the solenoid 24. A valve member 32 is mounted on the end of the armature or valve stem 30 and is generally constructed of soft, resilient material. An internal reinforcement plate of rigid material could be provided and would be attached directly to the armature 30. The valve member 32 has a generally circular configuration having a diameter wider than the aperture 12 so as to seat on the underside of the top of the chest about the circumference of the aperture. The valve member is provided with a cylindrical projection 34 having a circular cross-section with a diameter slightly less than the diameter of the cylindrical portion of the aperture 12. The cylindrical projection 34 can be of the same material as or of different material from the material of the valve member 32. The projection 34 is shown as a separate member in FIG. 1 and is secured to the valve member 32 by any suitable means compatible with the materials utilized.

The distance a valve member bounces will be very small in proportion to the total distance the valve moves during opening. Furthermore, the more a valve can open the higher the enertia will be resulting in a correspondingly higher bounce. The height of the projection 34 has to be sufficient so that the projection 34 will not leave the cylindrical aperture 12 during a bounce of the valve member during closing operation. The diameter of the projection 34 should be substantially equal to but slightly less than the diameter of the aperture 12 so as to permit free sliding movement of the projection 34 within the cylinder 12 while still substantially filling the aperture. Assuming the diameter of the aperture to be one inch and the clearance of the projection 34 within the aperture 12 to be 0.005 inches, the air allowed to escape between the projection 34 and the wall of the aperture is only 0.01% of the air which can escape when the valve member is moved to the fully open position by the solenoid 24. Thus, the projection of the present invention on the valve member does not eliminate bounce but merely minimizes the amount of air which can escape from the chest during a valve bounce.

A modified form of valve member 38 is shown in FIG. 2 wherein the projection 40 is of integral one piece unitary construction with the valve member 38. The valve member and projection can be made of soft resilient material such as felt or the like and can be provided with suitable internal reinforcing means. It is obvious that the details of the pipe seat, the solenoid and the armature can be widely varied without affecting the scope of the present invention.

While the invention has been particularly shown and described with reference to preferred embodiments thereof, it would be understood by those in the art that the foregoing and other changes in form and detail may be made therein without departing from the spirit and scope of the invention.

What is claimed is:

1. In a wind chest for a pipe organ of the type having a plurality of cylindrical apertures in the upper surface thereof adapted to be in communication with the pipes of said organ and a valve means associated with each aperture to control the flow of air from the chest to the pipes, the improvement comprising each of said valve means having a valve member and means for moving said valve member into and out of engagement with the interior of the wind chest about the entire circumference of the respective aperture; said valve member being comprised of a circular disc-like member having a cylindrical projection concentrically located on and extending outwardly from one surface so as to be located within the circular aperture in the wind chest when the valve member is in engagement with the wind chest to prevent a pipe from speaking if the valve member should bounce slightly during closing.

* * * * *